US007438271B1

(12) United States Patent
Iannace

(10) Patent No.: US 7,438,271 B1
(45) Date of Patent: Oct. 21, 2008

(54) HOLDER AND WRINGER FOR A SPONGE

(76) Inventor: Christopher R. Iannace, 291 Myrtle Ave., Staten Island, NY (US) 10310

( * ) Notice: Subject to any disclaimer, the term of this patent is extended or adjusted under 35 U.S.C. 154(b) by 373 days.

(21) Appl. No.: 10/880,791

(22) Filed: Jun. 30, 2004

(51) Int. Cl.
*A47F 5/00* (2006.01)
*A47K 5/08* (2006.01)
*A47G 29/00* (2006.01)

(52) U.S. Cl. ..... 248/309.1; 15/244.1; 206/77.1; 211/72; 248/694

(58) Field of Classification Search ..... 248/309.1, 248/311.2, 113, 300, 305, 306, 690, 694; 15/244.1, 244.4, 245, 245.1, 261, 231, 264; 206/77.1, 204; 211/71.01, 72
See application file for complete search history.

(56) References Cited

U.S. PATENT DOCUMENTS 1,551,434 A 8/1925 Shiffer
2,469,060 A * 5/1949 Vosbikian et al. ..... 15/119.2
2,560,161 A * 7/1951 Fay et al. ..... 211/72
2,665,808 A * 1/1954 McAlister ..... 206/425
2,683,887 A * 7/1954 Bell ..... 15/119.2
2,750,099 A * 6/1956 Bemiss ..... 206/521.6
3,031,705 A * 5/1962 Herman et al. ..... 15/119.2
3,344,915 A * 10/1967 Rawlings ..... 206/440
3,483,583 A * 12/1969 Baumgartner ..... 15/119.2
3,919,950 A * 11/1975 Frazelle et al. ..... 108/185
4,548,340 A 10/1985 Messer
4,653,220 A * 3/1987 Olsen, Sr. ..... 43/57.1
4,688,479 A * 8/1987 Cunningham ..... 100/133
4,974,281 A * 12/1990 Shaw ..... 15/261
5,148,948 A 9/1992 Granville et al.
D341,973 S 12/1993 Gerstmar
5,507,414 A 4/1996 Ong
5,575,032 A * 11/1996 Cernuska ..... 15/119.2
5,806,692 A * 9/1998 Pepper ..... 211/88.01
5,934,487 A * 8/1999 Hoeg ..... 211/50
6,067,683 A * 5/2000 Reeves ..... 15/105
6,129,219 A * 10/2000 Peickert ..... 211/74

* cited by examiner

*Primary Examiner*—Amy J. Sterling
*Assistant Examiner*—Tan Le
(74) *Attorney, Agent, or Firm*—Richard L. Miller

(57) ABSTRACT

A holder and wringer for a sponge, that includes a sheet of material holding the sponge and resting in a soap dish having a liquid soap dispenser thereon. The sheet of material is microwavable allowing sanitizing thereof and springy allowing squeezing thereof for wringing out the sponge held therein. The sheet of material is bent so as to have an N-shaped lateral cross section. A front wall and an intermediate wall define a V-shaped lateral cross section forming a cradle for holding the sponge, and when the front wall is pressed towards the intermediate wall, the sponge is squeezed therebetween and wrung out. The front wall and the intermediate wall meet at a fold having a pair of terminal ends. The fold is concave for directing drainage towards the terminal ends thereof to facilitate draining.

11 Claims, 2 Drawing Sheets

HOLDER AND WRINGER FOR A SPONGE

BACKGROUND OF THE INVENTION

1. Field of the Invention

The present invention relates to a holder and wringer, and more particularly, the present invention to a holder and wringer for a sponge.

2. Description of the Prior Art

Numerous innovations for toilet articles have been provided in the prior art that will be described. Even though these innovations may be suitable for the specific individual purposes to which they address, however, they differ from the present invention.

A FIRST EXAMPLE, U.S. Pat. No. 1,551,434 to Shiffer teaches a flat body having outstanding means thereon for supporting various toilet articles. The body having its edges, adjacent its bottom formed with V-shaped notches. A ball-shaped towel support of resilient material having offset ends pocketed in the body in a line with the notches. The sides of the support, at the juncture of the angle ends thereof being angularly disposed for contacting engagement with the opposite walls of the notches when the support is swung against or at an outward angle on the body.

A SECOND EXAMPLE, U.S. Pat. No. 4,548,340 to Messer teaches a liquid dispenser for flush-mounting in a wall that includes a faceplate with front and back surfaces and inlet and outlet openings. A liquid reservoir is attached to and extends rearwardly from the faceplate back surface. A fill spout communicates with the reservoir through the inlet opening and a plunger-type pump communicates with the reservoir through the outlet opening. The fill spout and the pump extend forwardly from the faceplate front surface. The faceplate is adapted for attachment to the wall with the reservoir positioned substantially within the wall.

A THIRD EXAMPLE, U.S. Pat. No. 5,148,948 to Granville et al. teaches a liquid soap dispenser and a mounting base for connection to a counter top on a sink in a public washroom to prevent the unauthorized removal of the dispenser. The dispenser includes a bottle having a spherical bottom wall which prevents the bottle from being self-supporting if removed from the mounting base.

A FOURTH EXAMPLE, U.S. Pat. No. Des. 341,973 to Gerstmar teaches the ornamental design for a combination sponge caddy and fluid dispenser housing.

A FIFTH EXAMPLE, U.S. Pat. No. 5,507,414 to Ong teaches an apparatus for dispensing liquid cleaning substances and that is particularly useful for dispensing dishwashing detergents. The device is formed with a base and a means for supporting a liquid detergent container above the base. This support may take the form of an encircling wall that defines an enclosure for a pump style detergent container having a laterally projecting spout mounted in its mouth, or an upright stanchion that holds a detergent container at an elevated level above the base. In either event the device is provided with a concave, upwardly facing liquid detergent receptacle located atop the base and directly beneath the dispensing orifice of the liquid detergent container. A sponge support is formed atop the liquid detergent receptacle. The sponge support may include a mesh screen and is hinged relative to the base to rotate about a horizontal axis. The sponge support may be moved between a lowered, horizontal disposition directly above the liquid detergent receptacle and a raised disposition out of vertical alignment between the dispensing orifice and the liquid detergent receptacle. The sponge support provides a convenient place for storing a kitchen sponge, and also allows the sponge to dry out.

A SIXTH EXAMPLE, U.S. Pat. No. 5,575,032 to Cernuska teaches a sponge shower cleaner for wiping a surface exposed to moisture, such as vertical shower wall, including a cleaning head formed from an absorbent material having a leading cleaning surface and an inclined surface. The inclined surface extends away from the leading cleaning surface at an angle. A cleaning head holder includes a guideway track for receipt and mounting of the cleaning head thereon. A wringing member is connected to the holder and defines a space between the cleaning head inclined surface and the wringing member. An elongated handle is thus two feet in length is connected to the holder and allows the user to orient the leading cleaning surface against and along the surface to be cleaned. The handle is usable with one hand to press the wringing member and the inclined surface against the surface to compress the absorbent material of the cleaning head to extract any moisture and any particulate matter picked up by the cleaning head.

It is apparent that numerous innovations for toilet articles have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a holder and wringer for a sponge that avoids the disadvantages of the prior art.

ANOTHER OBJECT of the present invention is to provide a holder and wringer for a sponge that is simple to use.

BRIEFLY STATED, STILL ANOTHER OBJECT of the present invention is to provide a holder and wringer for a sponge. The holder and wringer includes a sheet of material holding the sponge and resting in a soap dish having a liquid soap dispenser thereon. The sheet of material is microwavable allowing sanitizing thereof and springy allowing squeezing thereof for wringing out the sponge held therein. The sheet of material is bent so as to have an N-shaped lateral cross section. A front wall and an intermediate wall define a V-shaped lateral cross section forming a cradle for holding the sponge, and when the front wall is pressed towards the intermediate wall, the sponge is squeezed therebetween and wrung out. The front wall and the intermediate wall meet at a fold having a pair of terminal ends. The fold is concave for directing drainage towards the terminal ends thereof to facilitate draining.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 2:
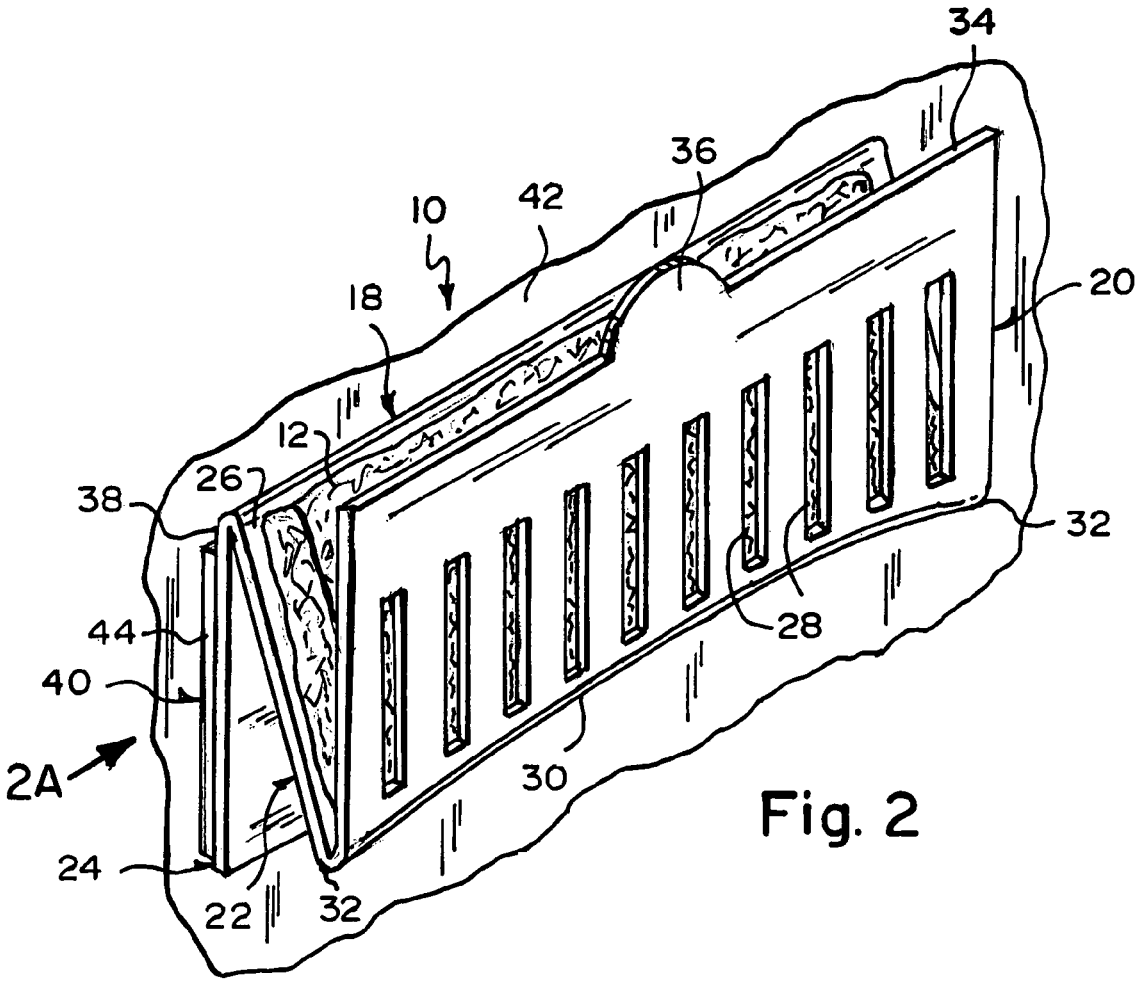
FIG. 2 is an enlarged diagrammatic front perspective view of the present invention identified by ARROW 2 in FIG. 1 attached to a vertical surface.

| | |
|---|---|
| 10 | holder and wringer of present invention for sponge 12 and resting in soap dish 14 having liquid soap dispenser 16 thereon |
| 12 | sponge |
| 14 | soap dish |
| 16 | liquid soap dispenser |
| 18 | sheet of material for resting in soap dish 14 and for holding sponge 12 and for allowing wringing of sponge 12 once removed from soap dish 14 |
| 20 | front wall |
| 22 | intermediate wall |
| 24 | rear wall |
| 26 | cradle defined by front wall 20 and intermediate wall 22 for holding sponge 12 |
| 28 | plurality of through slots in front wall 20 for draining when sponge 12 is wrung out |
| 30 | fold where front wall 20 and intermediate wall 22 meet for directing drainage towards terminal ends 32 thereof to facilitate draining |
| 32 | pair of terminal ends of fold 30 |
| 34 | uppermost edge 34 of front wall 20 |
| 36 | tab on uppermost edge 34 of front wall 20 |
| 38 | rearwardmost surface of rear wall 24 |
| 40 | attaching apparatus for attaching holder and wringer 10 to vertical surface 42 |
| 42 | vertical surface |
| 44 | double sided tape of attaching apparatus 40 |
| 46 | hook and loop fasteners of attaching apparatus 40 |
| 48 | front compartment of soap dish 14 |
| 50 | rear compartment of soap dish 14 |
| 52 | front wall of front compartment 48 of soap dish 14 |
| 54 | rear wall of front compartment 48 of soap dish 14 |
| 56 | pair of side walls of front compartment 48 of soap dish 14 |
| 58 | through bore in front compartment 48 of soap dish 14 for drainage from sponge 12 |
| 160 | plate of attaching apparatus 146 |
| 162 | at least one suction cup on a front surface 163 of plate 160 |
| 163 | front surface of plate 160 |
| 164 | rear surface of plate 160 |
| 166 | tab on front surface 163 of plate 160 |
| 168 | through slot in rear wall 24 of sheet of material 18 that receive tab 166 |
| 170 | lowermost edge of rear wall 24 of sheet of material 18 |

DETAILED DESCRIPTION OF THE PREFERRED EMBODIMENT

Referring now to the figures, in which like numerals indicate like parts, and particularly to figure, the holder and wringer of the present invention is shown generally at 10 for a sponge 12 and resting in a soap dish 14 having a liquid soap dispenser 16 thereon.

Figure 1:
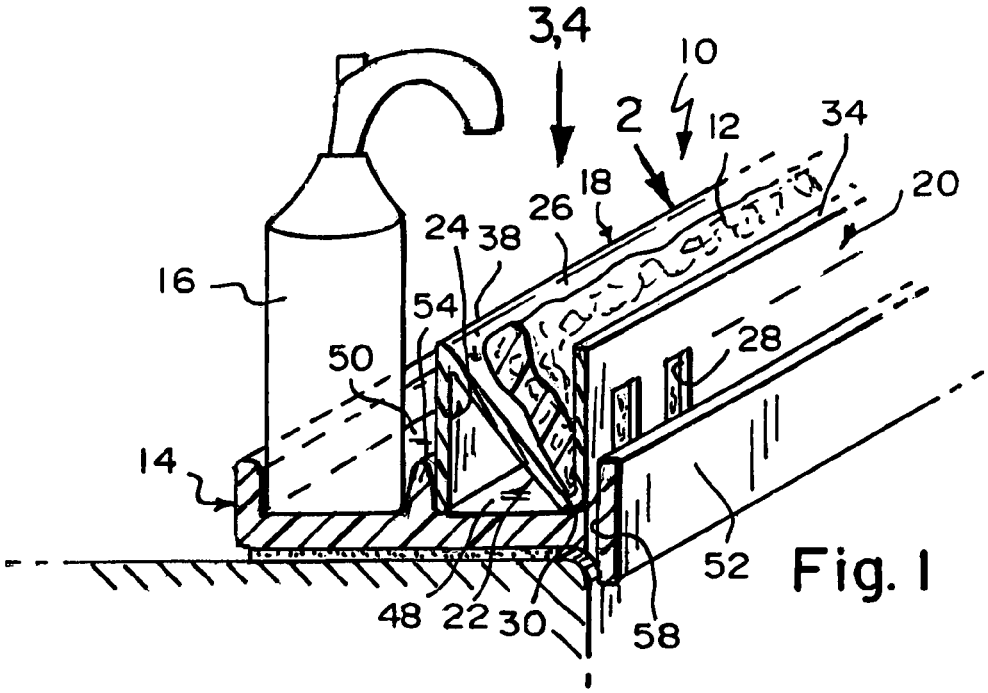
FIG. 1 is a partial diagrammatic perspective view in cross section of the present invention in use with a soap dish.

The configuration of the holder and wringer 10 can best be seen in FIGS. 1 and 2, and as such, will be discussed with reference thereto.

The holder and wringer 10 comprises a sheet of material 18. The sheet of material 18 is so configured for resting in the soap dish 14, for holding the sponge 12, and for allowing wringing of the sponge 12 once removed from the soap dish 14.

The sheet of material 18 is microwavable so as to allow sanitizing thereof.

The sheet of material 18 is a springy material, such as, but not limited to, flexible plastic, so as to allow squeezing thereof for wringing out the sponge 12 held therein.

The sheet of material 18 is bent so as to have an N-shaped lateral cross section, and as a result thereof, has a front wall 20, an intermediate wall 22, and a rear wall 24.

The front wall 20 and the intermediate wall 22 define a V-shaped lateral cross section so as to form a cradle 26. The cradle 26 is for holding the sponge 12. When the front wall 20 is pressed towards the intermediate wall 22, the sponge 12 is squeezed therebetween and wrung out.

The intermediate wall 22 and the rear wall 24 define an inverted V-shaped lateral cross section.

The front wall 20 has a plurality of through slots 28. The plurality of through slots 28 in the front wall 20 are for draining when the sponge 12 is wrung out, and are vertically-oriented for directing the drainage downwardly.

The front wall 20 and the intermediate wall 22 meet at a fold 30 with a pair of terminal ends 32. The fold 30 is concave for directing drainage towards the terminal ends 32 thereof to facilitate draining.

The front wall 20 has an uppermost edge 34. The uppermost edge 34 of the front wall 20 has a tab 36. The tab 36 extends upwardly from the uppermost edge 34 of the front wall 20, midway therealong, and facilitates pressing the front wall 20 towards the intermediate wall 22.

The rear wall 24 has a rearwardmost surface 38. The rearwardmost surface 38 of the rear wall 24 has attaching apparatus 40 cooperating therewith. The attaching apparatus 40 is for attaching the sheet of material 18 to a vertical surface 42.

Figure 3:
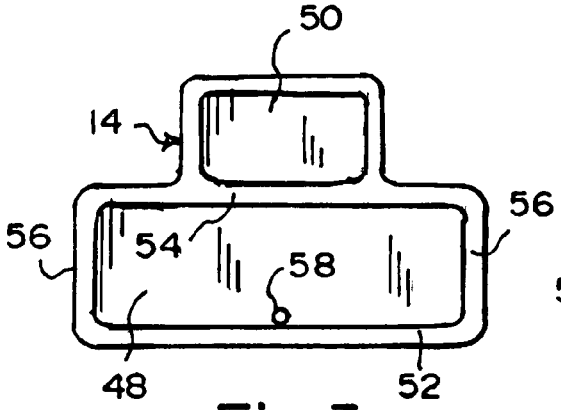
FIG. 3 is a diagrammatic top plan view of a first embodiment of a soap dish identified by ARROW 3 in FIG. 1.
Figure 4:
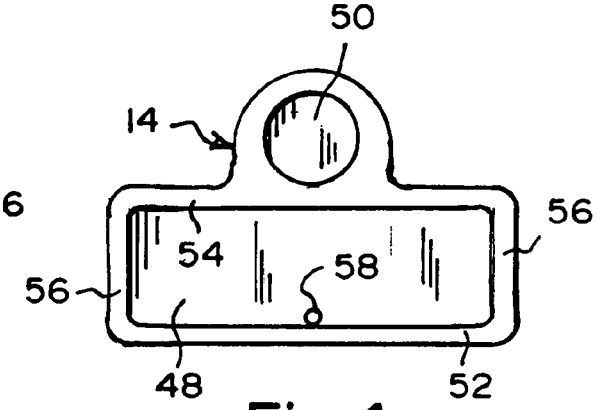
FIG. 4 is a diagrammatic top plan view of a second embodiment of a soap dish identified by ARROW 4 in FIG. 1.
Figure 6:
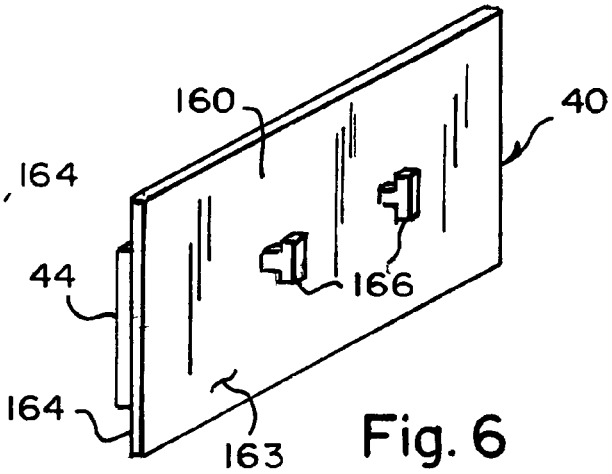
FIG. 6 is a diagrammatic front perspective view of a fourth embodiment of the attaching apparatus of the present invention.
Figure 2A:
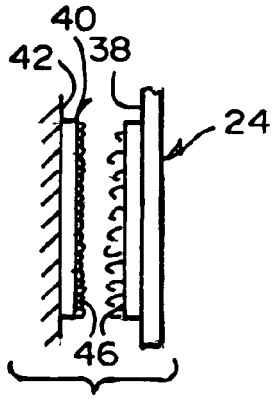
FIG. 2A is a side elevational view taken generally in the direction of ARROW 2A in FIG. 2 of a second embodiment of the attaching apparatus of the present invention.

In one embodiment, the attaching apparatus 40 is double sided tape 44 as shown in FIGS. 2 and 6 and in another embodiment, hook and loop fasteners 46 illustrated in FIG. 2A The configuration of the soap dish 14 can best be seen in FIGS. 1, 3, and 4, and as such, will be discussed with reference thereto.

The soap dish 14 has a front compartment 48. The front compartment 48 of the soap dish 14 is configured to hold the sheet of material 18.

The soap dish 14 further has a rear compartment 50. The rear compartment 50 of the soap dish 14 is configured to hold the liquid soap dispenser 16 by matching its configuration. As shown in FIG. 3, the rear compartment 50 of the soap dish 14 is configured to be rectangular to match a rectangular-shaped liquid soap dispenser 16 and as shown in FIG. 4, the rear compartment 50 of the soap dish 14 is configured to be round to match a round-shaped liquid soap dispenser 16.

The front compartment 48 of the soap dish 14 is formed by a front wall 52, a rear wall 54, and a pair of side walls 56 that connects the front wall 52 of the front compartment 48 of the soap dish 14 to the rear wall 54 of the front compartment 48 of the soap dish 14.

The front wall 20 of the sheet of material 18 abuts against the front wall 52 of the front compartment 48 of the soap dish 14 and the rear wall 24 of the sheet of material 18 abuts against the rear wall 54 of the front compartment 48 of the soap dish 14.

The front compartment 48 of the soap dish 14 has a through bore 58 for drainage from the sponge 12.

The through bore 58 in the front compartment 48 of the soap dish 14 abuts against the front wall 52 of the front compartment 48 of the soap dish 14, just below where the sponge 12 is held in the sheet of material 18.

Alternate embodiment for the attaching apparatus 40 can best be seen in FIGS. 5-7, and as such, will be discussed with reference thereto.

Figure 5:
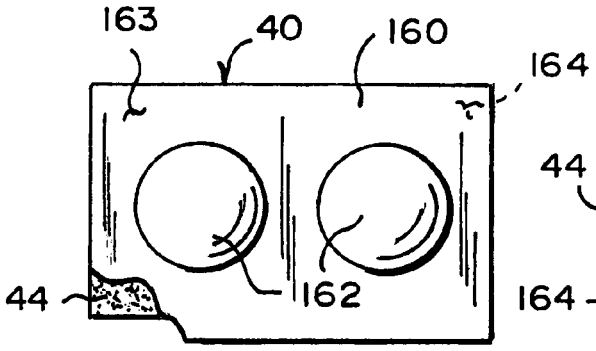
FIG. 5 is a diagrammatic front elevational view with parts broken away of a third embodiment of the attaching apparatus of the present invention.

The attaching apparatus 40 in FIG. 5, comprises a plate 160 and at least one suction cup 162 on a front surface 163. The at least one suction cup 162 of the plate 160 of the attaching apparatus 40 cooperates with the rear wall 24 of the sheet of material 18.

A rear surface 164 of the plate 160 of the attaching apparatus 40 in FIG. 5 has the double sided tape 44 thereon.

The front surface 163 of the plate 160 of the attaching apparatus 40 in FIG. 6 has a pair of spaced apart tabs 166 that extend therefrom while the double sided tape 44 is on the rear surface 164 of the plate 160.

Figure 7:
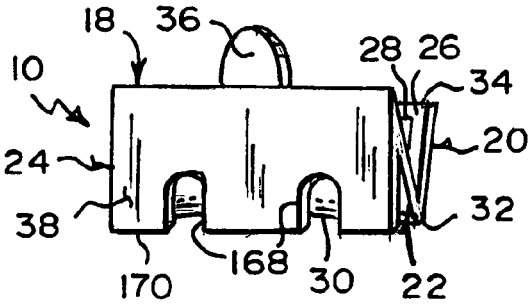
FIG. 7 is a diagrammatic rear perspective view of the present invention modified to be utilized with the fourth embodiment of the attaching apparatus.

FIG. 7 shows the rear wall 24 of the sheet of material 18 having two spaced apart through slots 168. Each through slot 168 extends upwardly from a lowermost edge 170 of the rear wall 24 of the sheet of material 18 and receives one the tab 166 of the attaching apparatus 40, and in so doing, holds the plate 160 of the attaching apparatus 40 to the rear wall 24 of the sheet of material 18.

It will be understood that each of the elements described above, or two or more together, may also find a useful application in other types of constructions differing from the types described above.

While the invention has been illustrated and described as embodied in a holder and wringer for a sponge, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A holder and wringer for a sponge and resting in a soap dish having a liquid soap dispensers thereon, said wringer comprising a sheet of material;

wherein said sheet of material is so configured for resting in the soap dish;

wherein said sheet of material is so configured for holding the sponge;

wherein said sheet of material is so configured for allowing wringing of the sponge once removed from the soap dish;

wherein said sheet of material has a front wall;

wherein said sheet of material has an intermediate wall;

wherein said sheet of material has a rear wall;

wherein said front wall has a tab;

wherein said tab of said front wall facilitates pressing said front wall towards said intermediate wall;

wherein said front wall has an uppermost edge;

wherein said tab extends upwardly from said uppermost edge of said front wall;

wherein said tab extends midway along said uppermost edge of said front wall;

wherein said sheet of material is bent so as to have an N-shaped lateral cross section;

wherein said sheet of material has a plurality of through slots; and wherein said plurality of through slots are for draining when the sponge is wrung out and;

wherein said plurality of through slots extend through said front wall.

2. The holder and wringer as defined in claim 1, wherein said sheet of material is microwavable so as to allow sanitizing thereof.

3. The holder and wringer as defined in claim 1, wherein said sheet of material is a springy material so as to allow squeezing thereof for wringing out the sponge held therein.

4. The holder and wringer as defined in claim 1, wherein said sheet of material is flexible plastic.

5. The holder and wringer as defined in claim 1, wherein said front wall and said intermediate wall of said sheet of material define a V-shaped lateral cross section so as to form a cradle; and wherein said cradle is for holding said sponge, and when said front wall is pressed towards said intermediate wall, said sponge is squeezed therebetween and wrung out.

6. The holder and wringer as defined in claim 1, wherein said intermediate wall and said rear wall define an inverted V-shaped lateral cross section.

7. The holder and wringer as defined in claim 1, wherein said plurality of through slots in said front wall are vertically-oriented for directing the drainage downwardly.

8. The holder and wringer as defined in claim 1, wherein said front wall and said intermediate wall meet at a fold; and wherein said fold is for directing drainage.

9. The holder and wringer as defined in claim 8, wherein said fold has a pair of terminal ends; and wherein said fold is concave for directing drainage towards said terminal ends thereof to facilitate draining.

10. The holder and wringer as defined in claim 1, wherein said rear wall has attaching apparatus cooperating therewith; and wherein said attaching apparatus is for attaching said sheet of material to a vertical surface.

11. The holder and wringer as defined in claim 10, wherein said rear wall has a rearwardmost surface; and wherein said attaching apparatus is disposed on said rearwardmost surface of said rear wall.

* * * * *